US007470345B2

(12) United States Patent
Troxell et al.

(10) Patent No.: US 7,470,345 B2
(45) Date of Patent: Dec. 30, 2008

(54) ROLLED PAPER PRODUCT HAVING HIGH BULK AND SOFTNESS

(75) Inventors: Clayton Charles Troxell, Appleton, WI (US); Tammy Lynn Baum, Neenah, WI (US); Kou-Chang Liu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 490 days.

(21) Appl. No.: 10/748,649

(22) Filed: Dec. 30, 2003

(65) Prior Publication Data

US 2005/0145353 A1 Jul. 7, 2005

(51) Int. Cl.
*D21F 5/00* (2006.01)

(52) U.S. Cl. ..... 162/118; 162/109; 162/117; 162/205; 428/153; 428/154; 428/141

(58) Field of Classification Search ..... 162/118, 162/100, 109, 117, 205; 428/153, 154, 141
See application file for complete search history.

(56) References Cited

U.S. PATENT DOCUMENTS

| | | | |
|---|---|---|---|
| 3,849,241 | A | 11/1974 | Butin et al. |
| 5,048,589 | A | 9/1991 | Cook et al. |
| 5,129,988 | A | 7/1992 | Farrington, Jr. |
| 5,399,412 | A | 3/1995 | Sudall et al. |
| 5,429,686 | A | 7/1995 | Chiu et al. |
| 5,494,554 | A | 2/1996 | Edwards et al. |
| 5,607,551 | A | 3/1997 | Farrington, Jr. et al. |
| 5,656,132 | A | 8/1997 | Farrington, Jr. et al. |
| 5,772,845 | A | 6/1998 | Farrington, Jr. et al. |
| 5,840,403 | A | 11/1998 | Trokhan et al. |
| 5,902,540 | A | 5/1999 | Kwok |
| 5,932,068 | A | 8/1999 | Farrington, Jr. et al. |
| 6,077,590 | A | 6/2000 | Archer et al. |
| 6,126,784 | A | 10/2000 | Ficke et al. |
| 6,171,442 | B1 | 1/2001 | Farrington, Jr. et al. |
| 6,398,910 | B1 | 6/2002 | Burazin et al. |
| 6,585,855 | B2 | 7/2003 | Drew et al. |
| 6,887,348 | B2 * | 5/2005 | Hermans et al. ..... 162/109 |
| 2003/0000664 | A1 | 1/2003 | Drew et al. |
| 2003/0085014 | A1 | 5/2003 | Hada et al. |
| 2003/0116888 | A1 | 6/2003 | Rymer et al. |
| 2003/0118848 | A1 | 6/2003 | Liu |

FOREIGN PATENT DOCUMENTS

| | | |
|---|---|---|
| WO | WO 2004/050992 A2 | 6/2004 |

* cited by examiner

*Primary Examiner*—Mark Halpern
(74) *Attorney, Agent, or Firm*—Gregory E. Croft

(57) ABSTRACT

Spirally wound single-ply web products having a chemical additive applied to at least one surface exhibit desirable roll bulk characteristics and softness properties. The rolled products can be made from a single-ply tissue web formed according to various processes. Once formed, the web is subjected to a shear-calendering device that increases the Fuzz-On-Edge properties of the web and preserves the bulk of the web when wound. The shear-calendered web then has a chemical additive applied to at least one surface by a non-compressive application method helping to maintain the Fuzz-On-Edge properties of the web.

24 Claims, 9 Drawing Sheets

ROLLED PAPER PRODUCT HAVING HIGH BULK AND SOFTNESS

BACKGROUND OF THE INVENTION

In the manufacture of paper products, such as bath tissue, a wide variety of product characteristics must be given attention in order to provide a final product with the appropriate blend of attributes suitable for the product's intended purposes. Improving the softness of tissues is a continuing objective in tissue manufacture, especially for premium products. Softness, however, is a perceived property of tissue comprising many factors including thickness, flexibility, smoothness, and fuzziness.

It is known that the perceived softness of tissues can be improved by the application of a chemical additive, such as a polysiloxane lotion, that is applied to the surface of the web. However, typical application methods such as printing using a gravure coater reduce the tissue's bulk from the compressive nip forces of the rotating rolls through which the web is passed. The printing process also tends to matt down any protruding fibers on the tissue's surface and covers them up with the applied chemical additive. Thus, the printing process creates more of a slicker smooth surface with the protruding fibers laid down and covered by the applied chemical additive as opposed to a fuzzy soft surface having protruding fibers, which can be preferred. Visualize a soft fuzzy teddy bear having lots of protruding fibers on its surface and then visualize that same bear dunked into baby oil lotion and run through a wringer (simulating the printing process). While the lotion coated surface of the teddy bear may feel smoother, it may not be perceived as soft as the uncoated surface having lots of protruding fibers.

Further aggravating the tissue's loss of bulk are the compressive forces exerted on the web during winding and converting. This process can also further reduce the tissue's fuzzy surface leading to a loss of softness. Thus, a need exists for a-wound paper product having a topically applied chemical that exhibits both high bulk and a fuzzy soft surface.

SUMMARY OF THE INVENTION

The present invention is generally directed to the production of spirally wound web products, such as tissue products, having a chemical additive applied to at least one surface that also possesses consumer desired roll bulk, as measured in cc/g, and sheet softness as measured by the Fuzz-On-Edge Test. The present invention is also directed to a process of making the tissue product using a shear-calendering device and a non-compressive coating device.

In one embodiment, the present invention is directed to a rolled tissue product made from a single-ply tissue web spirally wound into the roll. After being wound, the web has a roll bulk of about 9 cc/g or greater, about 10 cc/g or greater, about 11 cc/g or greater, about 12 cc/g or greater, about 13 cc/g or greater, between about 9 cc/g to about 16 cc/g, between about 10 cc/g to about 15 cc/g, or between about 11 cc/g to about 16 cc/g.

The web can have a Fuzz-On-Edge of at least one of the chemically treated surfaces of the web of about 1.8 mm/mm or greater, about 2.0 mm/mm or greater, about 2.4 mm/mm or greater, about 2.8 mm/mm or greater, about 3.0 mm/mm or greater, between about 1.8 mm/mm to about 3.5 mm/mm, between about 2.0 mm/mm to about 3.0 mm/mm, or between about 2.2 mm/mm to about 2.9 mm/mm.

The bone dry basis weight of the web can vary depending upon the product being produced. The bone dry basis weight can be about 25 grams per square meter (gsm) or greater, about 30 gsm or greater, about 35 gsm or greater, between about 20 gsm to about 60 gsm, or between about 25 gsm to about 45 gsm.

The Kershaw firmness of the rolls can be about 12 mm or less, about 11 mm or less, about 10 mm or less, between about 12 mm to about 0 mm, between about 11 mm to about 3 mm, or between about 10 mm to about 3 mm.

The CD Kawabata Bending Stiffness of the web can be about 0.06 gram-force $cm^2/cm$ or less, about 0.05 gram-force $cm^2/cm$ or less, about 0.04 gram-force $cm^2/cm$ or less, between about 0.06 to about 0.02 gram-force $cm^2/cm$, or between about 0.05 and 0.02 gram-force $cm^2/cm$.

The Wet Out Time of the web can be about 6 seconds or less, about 5 seconds or less, about 4 seconds or less, between about 3 seconds to about 6 seconds, or between about 3 seconds to about 5 seconds.

In one embodiment, in order to produce products having the above characteristics, the web is fed through a process that incorporates a shear-calendering device and then a chemical additive is applied to at least one surface of the web by a non-compressive application method. The non-compressive application method can include extruding a viscous composition onto the web.

BRIEF DESCRIPTION OF THE DRAWINGS

A full and enabling disclosure of the present invention, including the best mode thereof to one of ordinary skill in the art, is set forth more particularly in the specification, including reference to the accompanying Figures in which.

Figure 1:
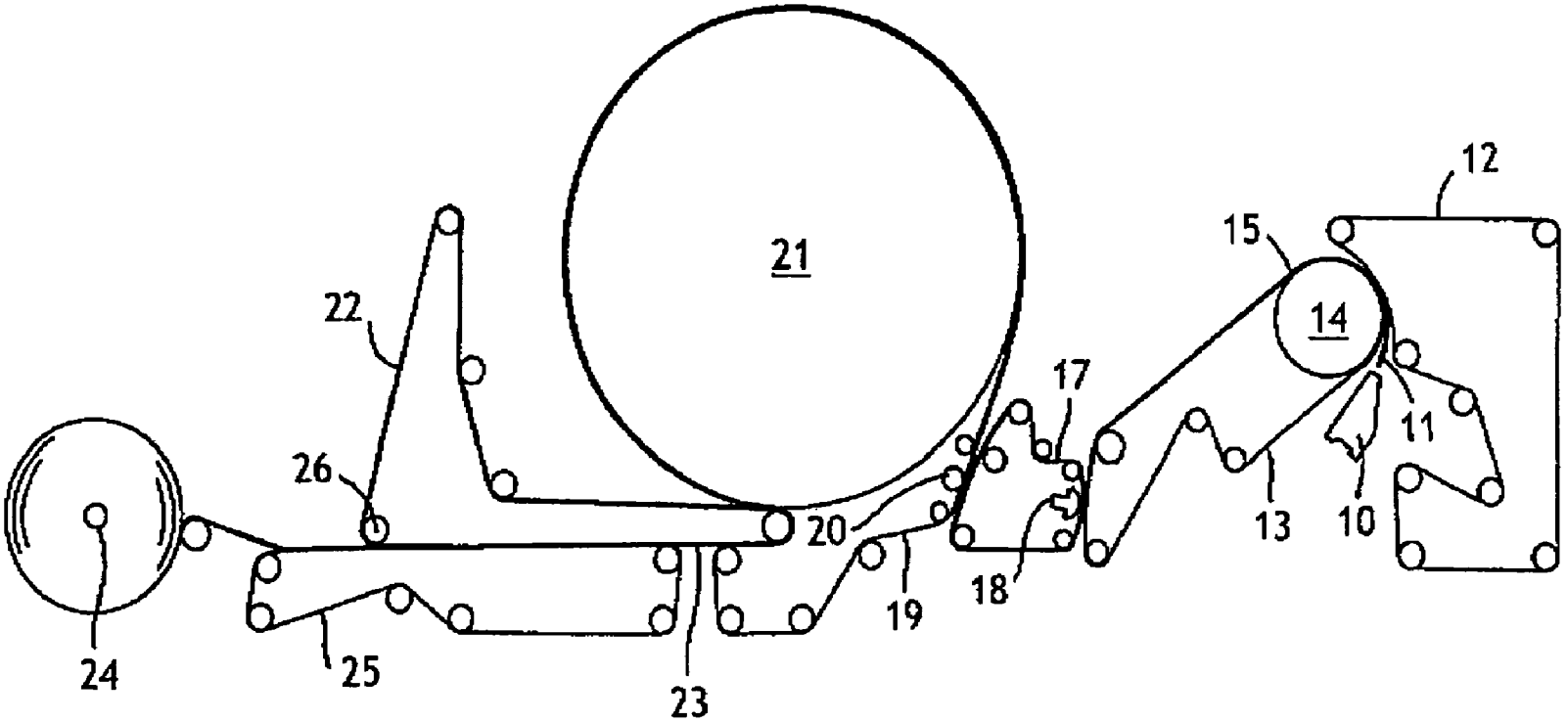
FIG. 1 illustrates a side view of one embodiment of a process for making base webs.

Repeated use of reference characters in the present specification and drawings is intended to represent the same or analogous features or elements of the present invention.

DETAILED DESCRIPTION OF THE INVENTION

It is to be understood by one of ordinary skill in the art that the present discussion is a description of exemplary embodiments only, and is not intended as limiting the broader aspects of the present invention, which broader aspects are embodied in the exemplary construction.

Base webs that may be used in the process of the present invention can vary depending upon the particular application. In general, any suitably made base web may be used in the process of the present invention, such as paper webs, non-woven webs or conform webs. Further, the webs can be made from any suitable type of fiber. For instance, the base web can be made from pulp fibers, other natural fibers, synthetic fibers, and the like. Suitable base webs can include mixtures of various fibers.

Fibers useful for purposes of this invention include any cellulosic fibers which are known to be useful for making paper, particularly those fibers useful for making relatively low density papers such as facial tissue, bath tissue, paper towels, dinner napkins and the like. Suitable fibers include virgin softwood and hardwood fibers, as well as secondary or recycled cellulosic fibers, and mixtures thereof. Especially suitable hardwood fibers include eucalyptus and maple fibers. As used herein, secondary fibers means any cellulosic fiber which has previously been isolated from its original matrix via physical, chemical or mechanical means and, further, has been formed into a fiber web, dried to a moisture content of about 10 weight percent or less and subsequently reisolated from its web matrix by some physical, chemical or mechanical means.

Webs made in accordance with the present invention can be made with a homogeneous fiber furnish or can be formed from a stratified fiber furnish producing layers within the single ply product. Stratified base webs can be formed using equipment known in the art, such as a multi-layered headbox or air laid web formers. Both strength and softness of the base web can be adjusted as desired utilizing layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present invention includes a first outer layer and a second outer layer containing primarily hardwood fibers. The hardwood fibers can be mixed, if desired, with paper broke and/or softwood fibers. The single ply base web further includes a middle layer positioned in between the first outer layer and the second outer layer. The middle layer can contain primarily softwood fibers. If desired other fibers, such as high-yield fibers or synthetic fibers may be mixed with the softwood fibers.

When constructing a base web from a stratified fiber furnish, the relative weight of each layer can vary depending upon the particular application. For example, in one embodiment, when constructing a base web containing three layers, each layer can be from about 15 percent to about 50 percent of the total weight of the base web, such as from about 25 percent to about 35 percent of the weight of the base web.

In one embodiment, the base web can be formed by any of a variety of papermaking processes known in the art. In fact, any process capable of forming a web can be utilized in the present invention. One possible papermaking process is a wet-pressing process in which a significant amount of water is removed from a wet-laid web by pressing the web prior to final drying. In one embodiment, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer with a doctor blade (creping), which serves to partially debond the dried web by breaking many of the bonds previously formed during the wet-pressing stages of the process. Creping generally improves the softness of the web, albeit at the expense of a loss in strength.

Another possible papermaking process is a throughdried tissue process. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until it is relatively dry. The resulting dried web is softer and bulkier than a wet-pressed sheet because fewer papermaking bonds are formed and because the web is less dense. Squeezing water from the wet web is eliminated, although subsequent transfer of the web to a Yankee dryer for creping is still often used to final dry and/or soften the resulting tissue.

Another possible papermaking process for forming high bulk paper sheets is disclosed in U.S. Pat. Nos. 5,607,551; 5,772,845; 5,656,132; 5,932,068; and 6,171,442 issued to Farrington Jr. et al., which are all incorporated herein by reference. These patents disclose soft throughdried tissues made without the use of a Yankee dryer. The typical Yankee functions of building machine direction and cross-machine direction stretch are replaced by a wet-end rush transfer and the throughdrying fabric design, respectively.

Other possible papermaking processes can utilize adhesive creping, wet creping, double creping, embossing, wet-pressing, air pressing, through-air drying, creped through-air drying, uncreped through-air drying, as well as other steps in forming the paper web. Some 25 examples of such techniques are disclosed in U.S. Pat. No. 5,048,589 to Cook, et al.; U.S. Pat. No. 5,399,412 to Sudall et al.; U.S. Pat. No. 5,129,988 to Farrington, Jr.; and U.S. Pat. No. 5,494,554 to Edwards et al.; which are incorporated herein in their entirety by reference.

In one embodiment, the base web is formed by an uncreped through-air drying process. Referring to FIG. 1, a schematic process flow diagram illustrating a method of making uncreped throughdried sheets in accordance with this embodiment is illustrated. Shown is a twin wire former having a papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent. Specifically, the suspension of fibers is deposited on the forming fabric 13 between a forming roll 14 and another dewatering fabric 12. Additional dewatering of the wet web can be carried out, such as by vacuum suction, while the wet web is supported by the forming fabric.

The wet web is then transferred from the forming fabric 13 to a transfer fabric 17 traveling at a slower speed than the forming fabric in order to impart increased stretch into the web. Transfer is preferably carried out with the assistance of a vacuum shoe 18 and a kiss transfer to avoid compression of the wet web.

The web is then transferred from the transfer fabric to the throughdrying fabric 19 with the aid of a vacuum transfer roll 20 or a vacuum transfer shoe. The throughdrying fabric can be traveling at about the same speed or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired bulk and appearance.

The level of vacuum used for the web transfers can be, for instance, from about 3 to about 15 inches of mercury (75 to about 380 millimeters of mercury), such as about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate 25 transfer of the web from carrier fabric 22 to fabric 25. Suitable carrier fabrics for this purpose are Albany International 84M or 94M and Asten 959 or 937, all of which are relatively smooth fabrics having a fine pattern.

Softening agents, sometimes referred to as debonders, can be used to enhance the softness of the tissue product and such softening agents can be incorporated with the fibers before, during or after formation of the aqueous suspension of fibers. Such agents can also be sprayed or printed onto the web after formation, while wet. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di(hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

In the illustrated process, it is preferable to include a transfer fabric to improve the smoothness of the sheet and/or impart sufficient stretch. As used herein, "transfer fabric" is a fabric which is positioned between the forming section and the drying section of the web manufacturing process. The fabric can have a relatively smooth surface contour to impart smoothness to the web, yet must have enough texture to grab the web and maintain contact during a rush transfer. It is preferred that the transfer of the web from the forming fabric to the transfer fabric be carried out with a "fixed-gap" transfer or a "kiss" transfer in which the web is not substantially compressed between the two fabrics in order to preserve the caliper or bulk of the tissue and/or minimize fabric wear.

In order to provide stretch to the web, a speed differential is provided between fabrics at one or more points of transfer of the wet web. This process is known as rush transfer. The speed difference between the forming fabric and the transfer fabric can be from about 5 to about 75 percent or greater, such as from about 10 to about 35 percent. For instance, in one embodiment, the speed difference can be from about 15 to about 25 percent, based on the speed of the slower transfer fabric. The optimum speed differential will depend on a variety of factors, including the particular type of product being made. As previously mentioned, the increase in stretch imparted to the web is related to the increase in speed differential. For a single-ply uncreped throughdried bath tissue having a basis weight of about 30 grams per square meter, for example, a speed differential of from about 20 to about 30 percent between the forming fabric and a transfer fabric produces a stretch in the final product of from about 15 to about 25 percent. The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers.

The web is transferred to the throughdrying fabric for final drying preferably with the assistance of vacuum to ensure macroscopic rearrangement of the web to give the desired bulk and appearance. The use of separate transfer and throughdrying fabrics can offer various advantages since it allows the two fabrics to be designed specifically to address key product requirements independently. For example, the transfer fabrics are generally optimized to allow efficient conversion of high rush transfer levels to high MD stretch while throughdrying fabrics are designed to deliver bulk and CD stretch. It is therefore useful to have moderately coarse and moderately three-dimensional transfer fabrics, and throughdrying fabrics that are quite coarse and three dimensional in the optimized configuration. The result is that a relatively smooth sheet leaves the transfer section and then is macroscopically rearranged (with vacuum assist) to give the high bulk, high CD stretch surface topology of the throughdrying fabric. The sheet topology is changed from transfer to the throughdrying fabric and the fibers are macroscopically rearranged, including significant fiber-fiber movement.

The drying process can be any noncompressive drying method which tends to preserve the bulk or thickness of the wet web including, without limitation, throughdrying, infrared radiation, microwave drying, etc. Because of its commercial availability and practicality, throughdrying is well known and is one commonly used means for noncompressively drying the web for purposes of this invention. Suitable throughdrying fabrics include, without limitation, Asten 920A and 937A and Velostar P800 and 103A. Additional suitable throughdrying fabrics include fabrics having a sculpture layer and a load-bearing layer such as those disclosed in U.S. Pat. No. 5,429,686 issued to Chiu et al. and U.S. Pat. No. 6,398,910 issued to Burazin et al., both patents incorporated herein by reference. The web is preferably dried to final dryness on the throughdrying fabric, without being pressed against the surface of a Yankee dryer and without subsequent creping.

After the base web is formed, the base web undergoes a converting process where the base web is typically wound into a roll for final packaging. Prior to or during this converting process the base web is subjected to a shear-calendering process in order to generate a high value of fuzziness (Fuzz-On-Edge value) while maintaining sufficient tensile strength. Further information on shear calendering is disclosed in U.S. patent application Ser. No. 10/305,784 entitled Rolled Single Ply Tissue Product Having High Bulk, Softness, and Firmness filed on Nov. 27, 2002 and herein incorporated by reference.

The shear-calendering process compresses and shears the base web at the same time, effectively breaking some bonds formed between the fibers of the base web. The Fuzz-On-Edge characteristic of the base web, and thus the perceived softness, is increased without significantly sacrificing tensile strength or any other characteristic of the base web. In one embodiment, the bulk of a tissue base web can be largely maintained. At the very least, through this process, a greater amount of bulk remains in the web after the web is wound than in a traditional calendering process. The higher sheet bulk is manifested as higher product roll bulk at a fixed firmness while maintaining the required sheet softness.

Two examples of shear calendering devices for use in the present invention are roll-gap calendering and roll-belt shearing. Both of these examples are described in further detail. However, this invention is not limited to these two types of shear calendering processes or devices and is intended to include other methods prior to or during the conversion step that increases the Fuzz-On-Edge of the base web without unduly reducing sheet thickness.

Figure 2:
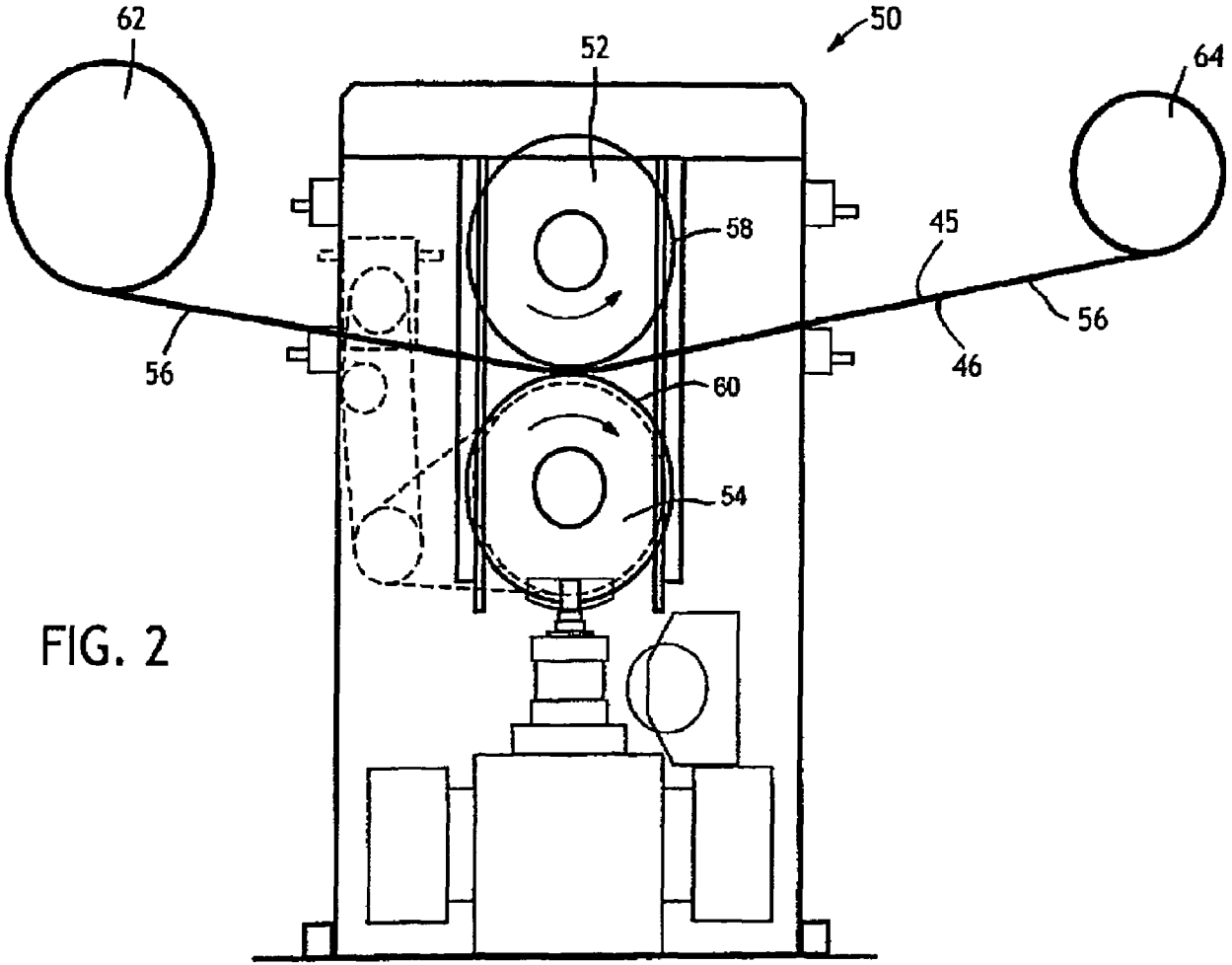
FIG. 2 illustrates a side view of one embodiment of a shear-calendering device.

Roll-gap calendering can cause in-plane shear to be imparted to the base web at relatively low compression levels in a calender nip in order to achieve higher fuzziness (softness) and higher calipers than conventional calendering resulting in higher bulk. Referring to FIG. 2, one embodiment of a roll-gap apparatus 50 is illustrated. In general, roll-gap calendering involves two calendering rolls 52 and 54 that compress and shear the base web 56. The surfaces 58 and 60 of calendering rolls 52 and 54 contacting base web 56 can comprise many materials, including paper, fabrics, metals such as steel or cast iron, or polymeric materials such as polyurethane, natural rubber (hard or soft), synthetic rubbers, elastomeric materials, and the like. Furthermore, the roll surfaces can be smooth, roughened, or etched. In one embodiment, both calendering rolls 52 and 54 have a surface 58 and 60 comprising a polymer material. In an alternative embodiment, one of the calendering rolls has a surface that is steel, while the other surface comprises a polymer material.

The calendering is achieved through compression of base web 56. The two calendering rolls 52 and 54 form a gap in the nip that ranges between about 2 percent and about 25 percent of the thickness of the base web. However, shear calendering may be achieved without the use of a gap between the two calendering rolls. Instead, the surfaces of the two rolls can be pressed together to form a pressure between the surfaces that compress the base web at a higher pressure than the gap. However, depending on the load settings and the z-direction properties of the web, it is possible to run the nipped mode at the same or even less pressure than the gap mode.

Both calendering rolls 52 and 54 rotate so their respective surfaces 58 and 60 move in the same direction as base web 56. For instance, in the embodiment shown in FIG. 2, base web 56 moves from an unwind roll 62 through the roll-gap calendering apparatus 50 and is rewound onto a roll 64. Thus, in this embodiment, calendering roll 52 is rotating counter-clockwise, and calendering roll 54 is rotating clockwise.

A higher degree of shearing is achieved by creating a greater speed differential between contacting surfaces 58 and 60 of calendar rolls 52 and 54, respectively. The speed differential between the surfaces contacting the web can be obtained by any means. For example, the rolls can have the same diameter and rotate at different speeds. Alternatively, the rolls can have different diameters and can be rotating at the same rotational speed, thus the surface speeds of the rolls are different because of the difference in the roll diameters.

Either surface 58 or 60 of calendering rolls 52 and 54 can move faster than the other. One of the surfaces is moving at the same speed as the web and thus is said to be gripping or carrying the web. Depending on which roll is carrying the base web, the other roll, which is moving at a different speed, generates the shearing force on the web. The carrying surface moves with base web 56 at the same speed, and the other surface moves between about 5 percent and about 100 percent either faster or slower than the carrying surface. The particular embodiment in FIG. 2 shows that calendering roll 52 is carrying the base web. Thus, in this embodiment, surface 58 of roll 52 is moving at the same speed as the base web 56, and surface 60 of roll 54 is moving faster or slower than base web 56 at a speed differential as described. Desirably, the speed of the web matches the speed of the carrying or gripping roll. Wrapping or contacting the carrying roll with the web at the point of shear will help avoid slippage of the web as it is sheared by the shearing roll. Preferably, the wrap angle upon exit of the nip is between 10 and 45 degrees.

The speed differential between surfaces 58 and 60 can be between about 5 percent and about 100 percent. When both surfaces 58 and 60 comprise an elastomer, the speed differential between the two calendering rolls can be between about 7 percent and about 40 percent, such as between about 7 percent and about 20 percent. Alternatively, when surface 58 comprises an elastomer and surface 60 comprises steel, the speed differential between surfaces can be between 7 percent and about 40 percent, such as between about 15 percent and about 25 percent.

For uncreped, through-air dried base webs, the fabric side (the side of the web contacting the dryer fabric) is generally softer than the air side, even before treatment by the shearing process. In one embodiment, the side of base web 56 that contacts the faster or slower moving shear calendaring surface is the fabric side of the web, and the side of base web 56 that contacts the carrying surface is the air side of the web. Thus, in the embodiment shown in FIG. 2, the first side 45 of base web 56 is the air side, and the second side 46 is the fabric side. This type of shearing process tends to make the fabric side even softer, while the air side remains relatively unchanged. However, it is also possible to treat the air side of the web rather than the fabric side, and in these embodiments, it would be possible to increase the air side softness to a level higher than that of the fabric side.

Either side of the base web 56 can optionally undergo a shear calendering process directed at shearing a targeted side of the web. The side of the web targeted for shearing would have the opposing side contacting the carrying roll surface. In the wound product, it is often advantageous to wind the product with the softest side on the roll's exterior surface. Thus, the shearing process is often performed on the surface of the web that will become the exterior surface in the wound product.

Roll-belt shearing is another type of a shearing process. Roll-belt shearing works the surface of the base web through aggressive shearing and has the capability of caliper, and thus bulk, control through adjusting the belt tension as well as the belt type. The in-plane shear is achieved by a speed differential between a belt and a roll. The belt tension generates pressure on the sheet that can serve to calender the base web, as well as shear the base web.

Figure 3:
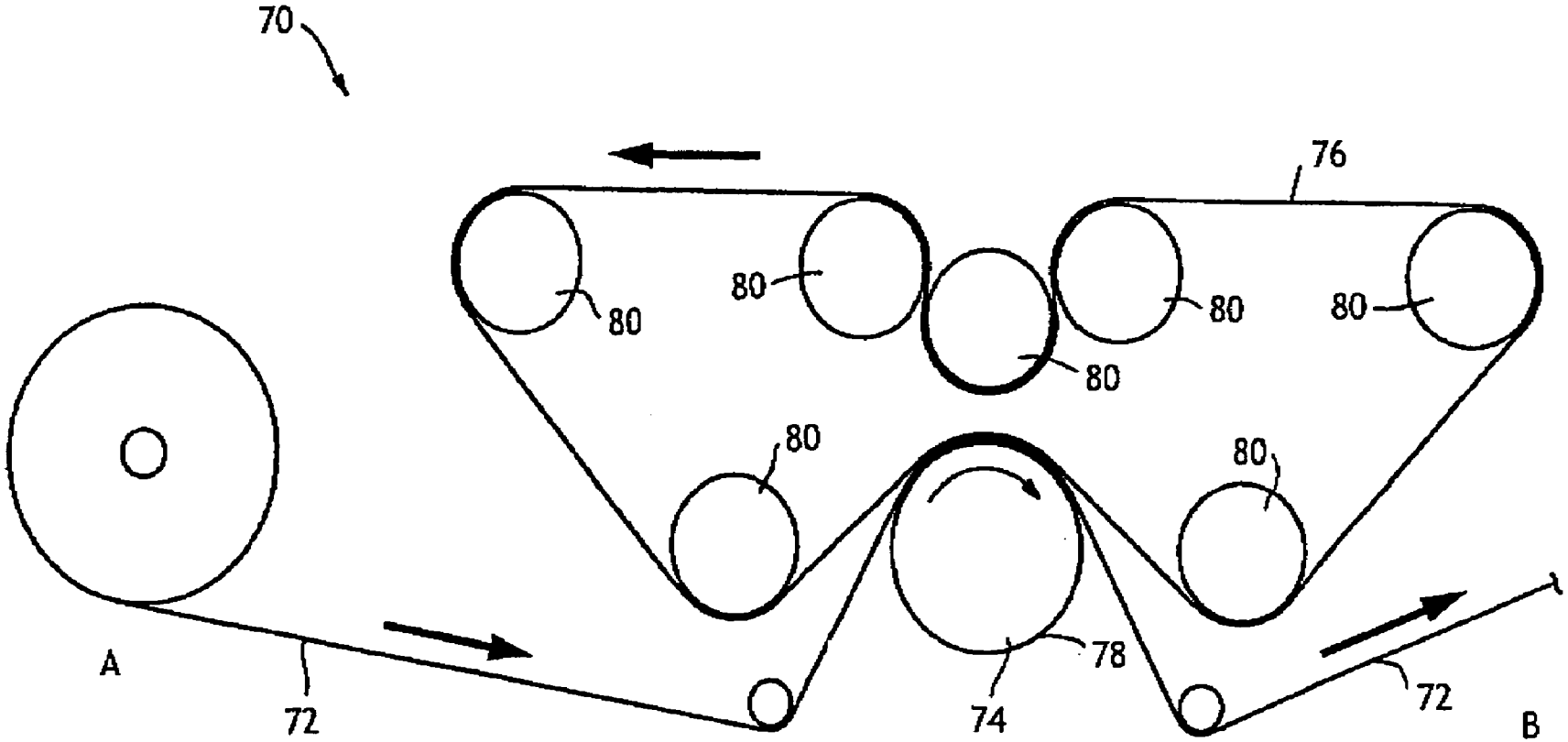
FIG. 3 illustrates a side view of another embodiment of a shear-calendering device.

Referring generally to one embodiment of a roll-belt apparatus 70 shown in FIG. 3, the roll-belt shearing process is generally described. In general, base web 72 is compressed and sheared by roll 74 and belt 76. Both the surface 78 of roll 74 and the belt 76 move in the same direction as base web 72. Thus, in the embodiment depicted in FIG. 3, the base web is traveling from A to B (in a left to right direction); therefore, roll 74 is rotating clockwise, and belt 76 is rotating around rollers 80 in a counterclockwise direction.

Belt 76 can be made from many various materials; for instance, the belt can be a woven or nonwoven fabric, a rubber belt, a cloth-like belt such as a felt, a metal wire belt, or the like. Also, the surface of belt 76 can be smooth, textured, roughened, or etched.

Likewise, roll 74 can comprise many materials, including metals such as steel, metals coated with substances, such as tungsten carbide coated on steel, or a polymer material, such as polyurethane, natural rubber (soft or hard), synthetic rubber, elastomeric materials, and the like. Also, the surface of the roll can be smooth, roughened, or etched.

Belt 76 has a tension around rollers 80. The tension of belt 76 can be measured by a Huyck tensiometer and reported in Huyck units, which is well known within the art. For the purposes of roll-belt shearing, the tension of belt 76 can be between about 45 and about 95 Huyck, such as between about 50 and about 80 Huyck. For instance, in one embodiment, the tension can be between about 60 and about 70 Huyck. The number and placement of rollers 80 can be any configuration that allows the roll-belt shearing apparatus to function accordingly.

In the nip between the roll 74 and belt 76, there can be a gap of about 0.0 inches to about 0.005 inches or the roll and the belt can press together. The gap distance, however, depends on the web being sheared. Also, either roll 74 or belt 76 can be moving faster than the other. The speed differential between roll 74 and belt 76 can be between about 5 percent and about 100 percent, such as between about 7 percent and about 50 percent. For instance, in one embodiment, the speed differential is between about 10 percent and about 20 percent. However, depending on the amount of friction in the nip, the speed differential can be varied to achieve desired results.

Depending on the coefficient of friction between belt 76 or roll 74 and base web 72 and the degree to which the web is held by the belt, either roll 74 or the belt 76 can move faster than the other. Depending on which side grips the sheet, the shear will primarily fuzz up the opposite side of the sheet. The shearing side can be moving faster or slower than the gripping side. Thus, there are four different possible embodiments of roll-belt shearing: 1) roll grips sheet, roll goes faster, 2) roll grips sheet, belt goes faster, 3) belt grips sheet, roll goes faster and 4) belt grips sheet, belt goes faster. Desirably, the speed of the web matches the speed of the carrying or gripping surface. Extending the contact between the web and the carrying surface after the nip will avoid slippage of the web as it is sheared by the shearing roll or belt. Preferably the wrap angle upon exit of the nip is between 10 and 45 degrees.

In one embodiment, after the base web is contacted with the shear-calendering device such as the roll-gap shearing device or the roll-belt shearing device as shown in FIGS. 2 and 3, the base web has a chemical additive applied to it using a non-compressive application method. However, it is possible in another embodiment to apply the chemical additive first to the base web and then contact the base web with the shear-calendering device.

In one embodiment, the non-compressive application method of applying a chemical additive to the base web included extruding a viscous composition onto the base web. The viscous composition has a viscosity sufficient for the composition to form filaments or fibers as the composition is extruded onto the web. In general, any suitable extrusion device can be used to apply the composition to the web. In one embodiment, for instance, the composition is extruded through a melt blown die and attenuated prior to being applied to the web. Further information on a suitable extrusion process for applying a chemical additive to a web is disclosed in U.S. patent application Ser. No. 10/036,735 entitled Method for the Application of Hydrophobic Chemicals to Tissue Webs filed on Dec. 21, 2001 and herein incorporated by reference.

Surprisingly, the inventors have discovered that the extrusion method of applying a chemical additive to the base web preserves a significant amount of the softness of the base web as measured by the Fuzz-On-Edge Test. Unlike a printing process, the base web's protruding fibers are not compressed by the extrusion process. Furthermore and unexpected, a significant portion of the fuzzy soft fibers generated by the shear-calendering device are not matted down after the chemical is applied to the surface. Without wishing to be bound by theory, it is believed that this result occurs since the extrusion method applies a filament or plurality or filaments containing the chemical onto selected portions of the base web. Depending on the nature of the applied chemical, the filaments may diffuse into or be absorbed by the fibers and/or the interstices of the tissue structure, or the filaments may remain substantially on the tissue's surface. The filaments are able to be present only in discrete areas leaving the remaining surface of the base web unchanged with its soft fuzzy texture. Unlike overall printing or a spraying method that could cover and matt down the entire surface of the base web, the discrete filaments in the above process are gently applied to the base web preserving its fuzzy softness.

Figure 4:
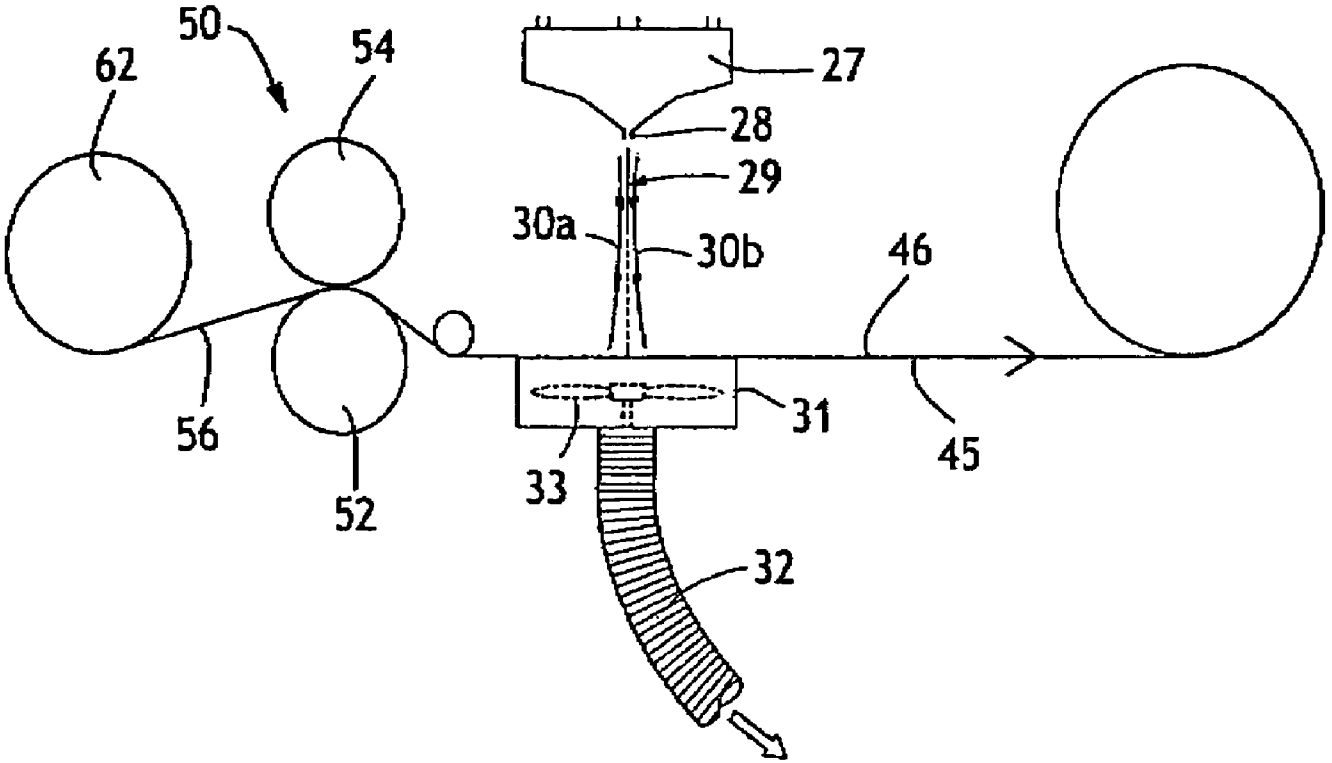
FIG. 4 illustrates a side view of one embodiment of a process for applying a chemical additive to the base web.

Referring to FIG. 4, one embodiment of a non-compressive chemical application process is illustrated. As shown, the base web 56 moves from left to right as it is unwound from the unwind roll 62. The first side 45 of the base web (air side in one embodiment) faces downwards and the second side 46 of the base web (fabric side in one embodiment) faces upward. The base web 56 receives a viscous composition stream 29 upon its second side 46. Prior to applying the viscous composition, the base web is directed through the previously described shear-calendering device 50. The second side 46, in one embodiment, comprises the fabric side of an uncreped throughdried paper web and it is this side that is subjected to the shearing force by calendering roll 54 having a speed differential relative to the base web. The base web is propelled by the calender roll 52 having the carrier surface.

It should be noted that the process described in FIG. 4 can be changed to apply the viscous composition to both sides (45 and 46) of the base web or to apply it to the first side 45. Furthermore, both sides (45 and 46) of the base web can be subjected to the shearing force produced by the shear calendering device. Additional equipment can be included in the process illustrated in FIG. 4. For example, a sheet cleaner that removes loose fibers and/or lint can be located adjacent to either side or both sides (45 and 46) of the base web prior to the application of the viscous composition stream 29. In another embodiment, either in conjunction with the sheet cleaner or by itself, a boundary air blocking device can be located adjacent to either side or both sides (45 and 46) of the base web prior to the application of the viscous composition stream 29. The boundary air blocking device can be used to enhance transfer of the viscous composition stream to the base web and/or prevent cellulosic fiber and dust build up on the nozzle of the melt blown die 27.

The process of shear calendering either one or both sides of a web and then applying a viscous composition to either one or both sides of the web with an extruder can be performed on single-ply or multi-ply webs. The multi-ply web can be run through the process with all of the layers present or one or more plies can be run through the process and then additional plies added to the multi-ply web afterwards.

A composition containing a chemical additive is extruded to form the viscous composition stream 29 that is directed onto the base web. In general, any suitable extrusion device can be used. In one embodiment, the extruder includes a melt blown die 27. A melt blown die is an extruder that includes a plurality of fine, usually circular, square or rectangular die capillaries or nozzles that can be used to form filaments. In one embodiment, a melt blown die can include converging high velocity gas (e.g. air) streams which can be used to attenuate the filaments exiting the nozzles. One example of a melt blown die is disclosed, for instance, in U.S. Pat. No. 3,849,241 to Butin, et al. and herein incorporated by reference. Another example of an extrusion device is a Uniform Fiber Depositor (UFD), manufactured by ITW Dynatec Corporation, 110 Taylor Industrial Boulevard, Hendersonville, Tenn. 37075. This device is described in U.S. Pat. No. 5,902,540 issued to Kwok and herein incorporated by reference.

The melt blown die 27 extrudes the viscous composition stream 29 from a die tip 28. As illustrated, the melt down die can be placed in association with an air curtain 30*a* and 30*b*. The air curtain 30*a-b* may completely surround the extruded composition stream 29, while in other applications the air curtain 30*a* and 30*b* may only partially surround the composition stream 29. When present, the air curtain can facilitate application of the composition to the base web, can assist in forming filaments from the composition being extruded and/or can attenuate any filaments that are being formed. Depending upon the particular application, the air curtain can be at ambient temperature or can be heated.

An exhaust fan 31 or vacuum box is located generally below the base web. The exhaust fan 31 or vacuum box is provided to improve air flow and to employ a pneumatic force to pull the composition stream 29 down on to the second side 46 of the base web. The exhaust fan 31 serves to remove from the immediate vicinity airborne particles or other debris through an exhaust duct 32. The exhaust fan 31 operates by pulling air using a rotating propeller 33 shown in dotted phantom in FIG. 4.

Figure 5:
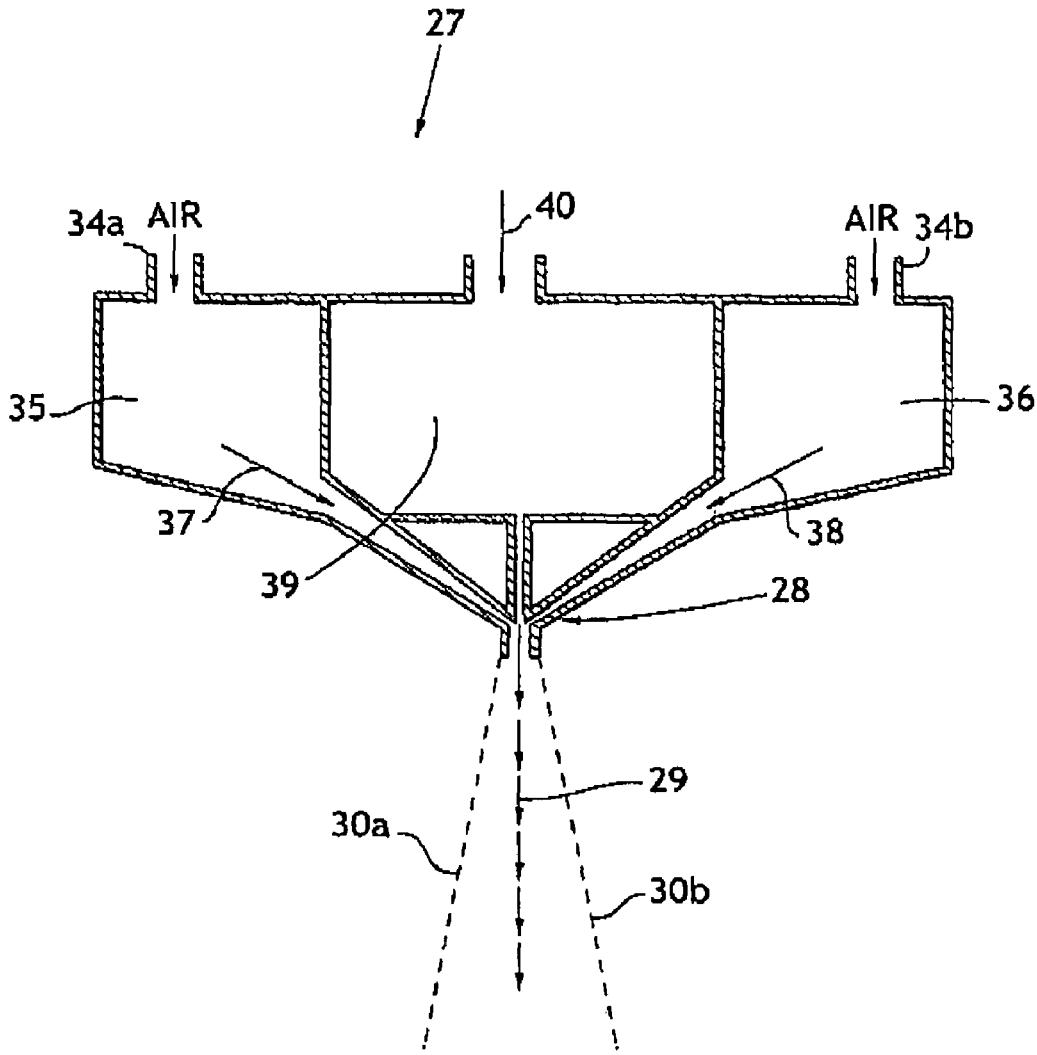
FIG. 5 illustrates a cross-section view of one embodiment of a melt blown die.

Referring now to FIG. 5, a more detailed view of the melt blown die 27 is shown in cross-section. An air intake 34*a* and 34*b* brings air into the melt blown die 27. Air travels into an air duct 35 and an air duct 36, respectively, from air intakes 34*a* and 34*b*. The air proceeds along an air pathway 37 and an air pathway 38, respectively, to a point near the center of the die tip 28 at which the air is combined with a viscous composition 40 containing the desired papermaking chemical. The viscous composition 40 emerges from a reservoir 39 to the die tip 28. Then, the composition travels downward as the viscous composition stream 29, shielded by air curtains 30*a* and 30*b*.

Figure 6:
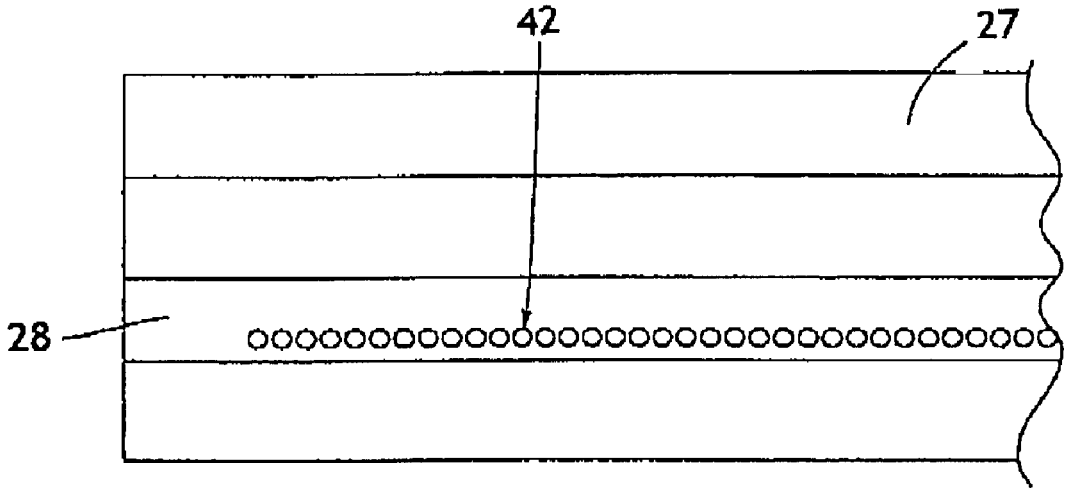
FIG. 6 illustrates a bottom view of the melt blown die of FIG. 5.

Referring now to FIG. 6, a bottom view of the melt blown die 27 is illustrated as it would appear looking upwards from the base web 56 (as shown in FIG. 4) along the path of the composition stream 29 to the point at which it emerges from the die tip 28. In one embodiment, the melt blown die 27 is comprised of a plurality of orifices 42 (several of which are shown in FIG. 6), and such orifices 42 may be provided in a single row as shown in FIG. 6. In other embodiments, there could be only a few scattered orifices 42; or perhaps, instead, a number of rows or even a series of channels could be used to release the viscous composition 40 from the melt blown die 27. In some cases, a combination of channels and orifices 42 could be used. In other cases (not shown), multiple rows of openings could be provided, and there is no limit to the different geometrical arrangement and patterns that could be provided to the melt blown die 27 for extruding a composition stream 29 within the scope of the invention.

In one embodiment of the invention, a pressurized tank (not shown) transfers a gas, such as air, to the melt blown die 27 for forcing the viscous composition 40 through the die tip 28. Viscous composition 40 is forced through the melt blown die 27 and extruded through, for instance, orifices comprising holes or nozzles spaced along the length of the die tip. In general, the size of the nozzles and the amount of the nozzles located on the melt blown die tip can vary depending upon the particular application.

For example, the nozzles can have a diameter from about 10 mils to about 50 mils, and particularly from about 14 mils to about 25 mils. The nozzles can be spaced along the die tip in an amount from about 3 nozzles per inch to about 50 nozzles per inch, and particularly from about 5 nozzles per inch to about 30 nozzles per inch. For example, in one embodiment, a die tip can be used that has approximately 17 nozzles per inch and each nozzle has a diameter of about 14 mils.

As discussed, in one embodiment, two streams of pressurized air converge on either side of the composition stream 29 after it exits the melt blown die 27. The resulting air pattern disrupts the laminar flow of the composition stream 29 and attenuates the filaments being formed as they are directed onto the surface of the base web. Different sized orifices or nozzles will produce filaments having a different diameter. The purpose for air pressure or air curtain 30*a* and 30*b* on either side of the viscous composition stream 29 (in selected embodiments of the invention) is to assist in the formation of filaments, to attenuate the filaments, and to direct the filaments onto the tissue web. Various air pressures may be used.

In general, the filaments that can be formed by the melt blown die according to the present invention can include discontinuous filaments and continuous filaments. The filaments can have various diameters depending upon the particular application. For instance, the diameter of the filaments can vary from about 5 microns to about 100 microns. In one embodiment, continuous filaments are formed having a diameter of about 25 microns.

The flow rate of the viscous composition 40 can be any desired amount based on the applied chemical and the intended usage of the paper. The flow rate may be, for instance, from about 2 grams/inch to about 9 grams/inch in one embodiment. The flow rate will depend, however, on the composition and chemical additive being applied to the paper web, on the speed of the moving paper web, and on various other factors. In one embodiment, the total add on rate of the composition (including add on to both sides of the base web if both sides are treated) can be up to about 10 percent based upon the weight of the paper web. When applying a softener to the base web, for instance, the add on rate can be from about 0.1 percent to about 5 percent by weight, and particularly from about 0.5 percent to about 3 percent by weight of the web.

The viscosity of the viscous composition 40 can also vary depending upon the particular circumstances. When it is desired to produce filaments through the melt blown die 27, the viscosity of the composition can be relatively high. For instance, the viscosity of the composition can be at least about 1000 centipoise (cps), about 2000 cps or greater, and about 3000 cps or greater. For example, the viscosity of the composition can be from about 1000 cps to about 50,000 cps, from about 1500 cps to about 10,000 cps, or from about 2,000 cps to about 5,000 cps as measured by a Brookfield viscometer.

The temperature of the viscous composition, as it is applied to the base web in accordance with the present invention, can vary depending upon the particular application. For instance, in some applications, the composition can be applied at ambient temperatures. In other applications, however, the composition can be heated prior to or during extrusion. The composition can be heated, for instance, in order to adjust the viscosity of the composition. The composition can be heated by a pre-heater prior to entering the melt blown die or, alternatively, can be heated within the melt blown die itself using, for instance, an electrical resistance heater.

In one embodiment, the composition containing the chemical additive can be a solid at ambient temperatures (from about 20° C. to about 23° C.). In this embodiment, the composition can be heated an amount sufficient to create a flowable liquid that can be extruded through the meltblown die. For example, the composition can be heated an amount sufficient to allow the composition to be extruded through the meltblown die and form filaments. Once formed, the filaments are then applied to a web in accordance with the present invention. The composition can resolidify upon cooling to reside primarily on the tissue's surface or the filaments can diffuse into the tissue's structure.

Examples of additives that may need to be heated prior to being deposited on a paper web include compositions containing behenyl alcohol. Other compositions that may need to be heated include compositions that contain a wax, that contain any type of polymer that is a solid at ambient temperatures, and/or that contain a silicone. One particular embodiment of a composition that may need to be heated in accordance with the present invention is the following:

| INGREDIENT | WEIGHT PERCENT |
|---|---|
| Mineral Oil | 25 |
| Acetylated Lanolin Alcohol (ACETULAN available from Amerchol) | 10 |
| Tridecyl Neopentoate | 10 |
| Cerasin Wax | 25 |
| DOW Corning 200 20 cSt | 30 |

The above composition is well suited for use as a chemical additive when applied to a cellulosic web. The above composition can be heated to a temperature, for instance, from about 75° C. to about 150° C.

In FIG. 4, the composition containing the chemical additive is applied to the second side 46 of the base web 56. It should be understood, however, that the composition can be applied to the first side 45 of the base web or to both sides of the web. The composition can be applied either before subjecting the base web to shear-calendering or after as illustrated. Furthermore, the melt blown die 27 can be used to apply compositions and chemicals to numerous and various different types of base webs. The invention is not limited to the use of paper webs such as facial tissues, bath tissue, or paper towels having a basis weight of less than about 60 gsm.

Without wishing to be bound by theory, it is believed that a paper web, treated in accordance with the present invention, will contain a plurality of fuzzy fibers on its surface generated by the shear calendering device and, in one embodiment, a plurality of chemical additive filaments formed from the viscous composition that are applied to the web by the melt blown die. However, in another embodiment, the chemical additive filaments may diffuse completely or partially into the tissue's structure and, as such, may not be discernable on the tissue's surface. In general, the chemical additive filaments are applied onto the tissue's surface in a random pattern, which intersects at various points while leaving discrete areas of the tissue's surface free of the applied chemical. The chemical additive filaments can form a network on the web's surface that can increase the strength, particularly the wet strength of the web depending on the chemical composition of viscous composition 40.

As mentioned, the chemical additive filaments can cover only a portion of the surface area of the web. In this regard, the composition used to form the chemical additive filaments can be applied to the web so as to cover from about 20 percent to about 80 percent of the surface of the web or from about 30 percent to about 60 percent of the surface area of the web. By leaving untreated areas on the web, the web remains easily wettable. In this manner, hydrophobic materials can be applied to the web for improving the properties of the web while still permitting the web to become wet in an acceptable amount of time when contacted with water.

Of particular advantage, the extrusion process is well suited to applying relatively high viscous compositions to webs. Since the process is capable of handling high viscosity compositions, various chemical additives can be added directly to a web without having to dilute the additive with, for instance, water or any other type of dilution agent to form a solution or emulsion. As a result, the process of the present invention can be more economical and less complex than many conventional application systems.

In one embodiment, a thickener can be added to the composition in order to increase the viscosity. The thickener can be, for instance, a polyethylene oxide. It should be understood, however, that any suitable or conventional thickener can also be used. In one embodiment, various additives can be added to the composition in order to adjust the viscosity of the composition. For instance, in one embodiment, a thickener can be applied to the composition in order to increase its viscosity. In general, any suitable thickener can be used in accordance with the present invention. For example, in one embodiment, polyethylene oxide can be combined with the composition to increase the viscosity. For example, polyethylene oxide can be combined with a polysiloxane softener to adjust the viscosity of the composition to ensure that the composition will produce filaments when extruded through the melt blown die.

Because the chemical additive is applied as filaments, for some applications, a lesser amount of the chemical additive can be applied to the web than what was necessary in many rotogravure processes while still obtaining an equivalent or better result. In particular, since the chemical additive can be applied in a relatively viscous form without having to be formed into an emulsion or a solution, and because the chemical additive can be applied as filaments over the web's surface, it is believed that the same or better results can be obtained without having to apply as much of the chemical additive as was utilized in many prior art processes. For example, a softener can be applied to a web as chemical additive filaments in a lesser amount while still obtaining the same softening effect in comparison to rotogravure processes and spray processes. Furthermore, since less of the chemical additive is needed, additional cost savings are realized.

The amount of the composition that is applied to the paper web depends on the particular application. For example, when applying a softener to a tissue web, the softener can be added in an amount from about 0.1 percent to about 10 percent by weight and particularly from about 0.1 percent to about 5 percent by weight, based upon the weight of the web. As described, in one embodiment, the composition is extruded through a melt blown die onto the paper web. The melt blown die can have a plurality of nozzles at a die tip. The nozzles can be arranged in one or more rows along the die tip. The filaments exiting the nozzles can have a diameter of from generally about 5 microns to about 100 microns or greater.

A composition containing a chemical additive can be applied to a web in the form of filaments or fibers, such as, for instance, in the form of continuous filaments. Under certain circumstances, compositions will form filaments or fiberize when extruded through the melt blown die tip. The ability to fiberize the compositions provides various advantages. For example, when formed into filaments, the composition is easily captured by the web. The filaments can also be placed on the web in specific locations. Further, when desired, the filaments will not penetrate through the entire thickness of the web, but instead, will remain on the surface of the web, where the chemical additives are intended to provide benefits to the user.

The viscous composition can include any chemical additive or mixture of chemical additives. For instance, the composition can be a topical preparation that improves the physical properties of the web such as strength, softness, or absorbency, that provides the web with anti-bacterial properties, that provides the web with medicinal properties, or that provides any other type of wellness benefits to a user of the paper web. Possible chemical additives that can be applied to the web include, without limitation, anti-acne actives, antimicrobial actives, antifungal actives, antiseptic actives, antioxidants, cosmetic astringents, drug astringents, aiological additives, deodorants, emollients, external analgesics, film formers, fragrances, humectants, natural moisturizing agents and other skin moisturizing ingredients known in the art, opacifiers, skin conditioning agents, skin exfoliating agents, skin protectants, solvents, sunscreens, and surfactants. The above chemical additives can be applied alone or in combination with other additives in accordance with the present invention. Suitable chemical additives are disclosed in U.S. Pat. No. 5,840,403 issued to Trokhan et al. on Nov. 24, 1998, and in U.S. Pat. No. 6,126,784 issued to Fricke et al. on Oct. 3, 2000, both of which are herein incorporated by reference.

In one embodiment, the chemical additive is a softener. The softener can be, for instance, a polysiloxane that makes a tissue product feel softer to the skin of a user. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals can be methyl groups, ethyl groups, and/or a straight branched or cyclic carbon chain containing from about 3 to about 8 carbon atoms. Some commercially available examples of polysiloxanes include WETSOFT CTW, AF-21, AF-23 and EXP-2025G of Kelmar Industries; Y-14128, Y-14344, Y-14461 and FTS-226 of the Witco Corporation; and Dow Corning 8620, Dow Corning 2-8182 and Dow Corning 2-8194 of the Dow Corning Corporation.

In the past, polysiloxanes were typically combined with water, preservatives, antifoamers, and surfactants, such as nonionic ethoxylated alcohols, to form stable and microbial-free emulsions and applied to tissue webs. However, the water and other ingredients added to the polysiloxane can reduce the fuzzy softness of the tissue by matting down the protruding fibers without significantly increasing the perceived softness of the tissue, especially during a printing process such as rotogravure printing.

Since the process of the present invention can accommodate higher viscosities, the polysiloxanes can be added directly to a tissue web or to another web without having to be combined with water, a surfactant or any other dilution agent. Thus, more of the fuzzy softness generated by the shear calendering device can be preserved. Eliminating water as a dilution agent can reduce the stiffness created by the moistened web as it dries, maintaining more of the fuzzy softness generated by the shear-calender device. For example, a neat composition, such as a neat polysiloxane can be applied to a web in accordance with the present invention. Since the polysiloxane can be applied to a web without having to be combined with any other ingredients, the process of the present invention is more economical and less complex than many prior processes. Further, lesser amounts of the chemical additive can be applied to the web while still obtaining the same or better results, which provides further cost savings.

A hydrophobic softener can be applied to a bath tissue web and still permit the bath tissue to disperse in water when disposed of. The softener, for instance, can be an aminopolydialkylsiloxane. In the past, when it has been attempted to apply softeners to bath tissue, typically, a hydrophilically modified polysiloxane was used. The hydrophobic polysiloxanes, such as aminopolydialkylsiloxanes, however, not only have better softening properties, but are less expensive. Further, as described above, the process of the present invention allows lesser amounts of the additive to be applied to the tissue product while still obtaining the same or better results than many conventional processes. Alternatively, a hydrophilically modified aminopolysiloxane such as Wetsoft CTW from Kelmar Industries (310 Spartangreen Blvd. Duncan, S.C. 29334) can be used to provide improved softness to a tissue web while also having a reduced impact on the absorbency or wettability of the treated tissue.

The hydrophobic composition is applied to the web in a discontinuous manner. For instance, the hydrophobic composition can be applied evenly across the surface of the web while containing various voids in the coverage for permitting the web to become wet when contacted with water. For example, in one embodiment, the hydrophobic composition is applied to the web as filaments that overlap across the surface of the web, but yet leave areas on the web that remain untreated. By applying the hydrophobic composition in a discontinuous manner, a tissue can be produced not only having a lotiony, soft feel, but also having good wettability, even with the addition of the hydrophobic composition. In this manner, viscous hydrophobic compositions can be applied to bath tissues for improving the properties of the tissue without significantly affecting the wettability of the tissue.

The extrusion process provides control over the amount of the composition applied to the web and the placement of the composition on the web without matting down the generated fuzzy softness of the shear-calendering process. Additionally, neat compositions of a desired chemical can be applied without the need for dilution with other chemicals, further preserving the fuzzy softness. It is believed that products made according to the process of the present invention have various unique characteristics.

For instance, in one embodiment, a product made according to the present invention includes a web containing cellulosic fibers. The web has the softness of at least one surface increased by subjecting the surface to a shear-calendering operation. A viscous composition containing a chemical additive is extruded onto at least one surface that was shear-calendered. The composition is present on the web in the form of filaments while still maintaining the fuzzy softness generated by the shear-calendering operation. After applying the chemical additive, the web is converted into a plurality of small rolls having a diameter of about 12 inches or less as known in the art. Such rolls are frequently sold as paper towel rolls and bath tissue rolls.

After being wound, the web has a roll bulk of about 9 cc/g or greater, about 10 cc/g or greater, about 11 cc/g or greater, about 12 cc/g or greater, about 13 cc/g or greater, between about 9 cc/g to about 15 cc/g, between about 10 cc/g to about 16 cc/g, or between about 11 cc/g to about 16 cc/g.

The web can have a Fuzz-On-Edge of at least one of the chemically treated surfaces of the web of about 1.8 mm/mm or greater, about 2.0 mm/mm or greater, about 2.4 mm/mm or greater, about 2.8 mm/mm or greater, about 3.0 mm/mm or greater, between about 1.8 mm/mm to about 3.5 mm/mm, between about 2.0 mm/mm to about 3.0 mm/mm, or between about 2.2 mm/mm to about 2.9 mm/mm.

The bone dry basis weight of the web can vary depending upon the product being produced. The bone dry basis weight can be about 25 grams per square meter (gsm) or greater, about 30 gsm or greater, about 35 gsm or greater, between about 20 gsm to about 60 gsm, or between about 25 gsm to about 45 gsm.

The Kershaw firmness of the rolls can be about 12 mm or less, about 11 mm or less, about 10 mm or less, between about 12 mm to about 0 mm, between about 11 mm to about 3 mm, or between about 10 mm to about 3 mm.

The CD Kawabata Bending Stiffness of the web can be about 0.06 gram-force $cm^2$/cm or less, about 0.05 gram-force $cm^2$/cm or less, about 0.04 gram-force $cm^2$/cm or less, between about 0.06 to about 0.02 gram-force $cm^2$/cm, or between about 0.05 and 0.02 gram-force $cm^2$/cm.

The Wet Out Time of the web can be about 6 seconds or less, about 5 seconds or less, about 4 seconds or less, between about 3 seconds to about 6 seconds, or between about 3 seconds to about 5 seconds.

Definitions

A "chemical additive" can be any useful chemical or mixture of various chemicals that enhances the functionality of the web for its intended purpose. Possible chemical additives include, without limitation, strength additives, absorbency additives, softener additives, surfactant additives, conditioning additives, aesthetic additives such as fragrances or dyes. Other additives include, without limitation, anti-acne additives, antimicrobial additives, antifungal additives, antiseptic additives, antioxidants, cosmetic astringents, drug astringents, deodorants, detergents, emollients, external analgesics, binders, film formers, skin moisturizing ingredients as known in the art, opacifiers, skin conditioning agents, skin exfoliating agents, skin protectants, sunscreens, vapor rubs and the like.

"Roll Bulk" is the volume of the web divided by its mass on the wound roll. Roll Bulk is calculated by multiplying pi (3.142) by the quantity obtained by calculating the difference of the roll diameter squared ($cm^2$) and the outer core diameter squared ($cm^2$) divided by 4 multiplied by the sheet length (cm) multiplied by the sheet count multiplied by the bone dry Basis Weight of the sheet in grams per centimeter squared ($g/cm^2$). For a solid roll, the core diameter is zero (0). Roll Bulk (cc/g)=3.142×(Roll Diameter squared ($cm^2$)−outer Core Diameter squared ($cm^2$)/(4×Sheet Length (cm)×Sheet Count×Bone Dry Basis Weight ($g/cm^2$)). Alternatively, Roll Bulk (cc/g)=0.785×(Roll Diameter squared ($cm^2$)−outer Core Diameter squared ($cm^2$)/(Sheet length (cm)×Sheet Count×Bone Dry Basis Weight ($g/cm^2$)).

Figure 7:
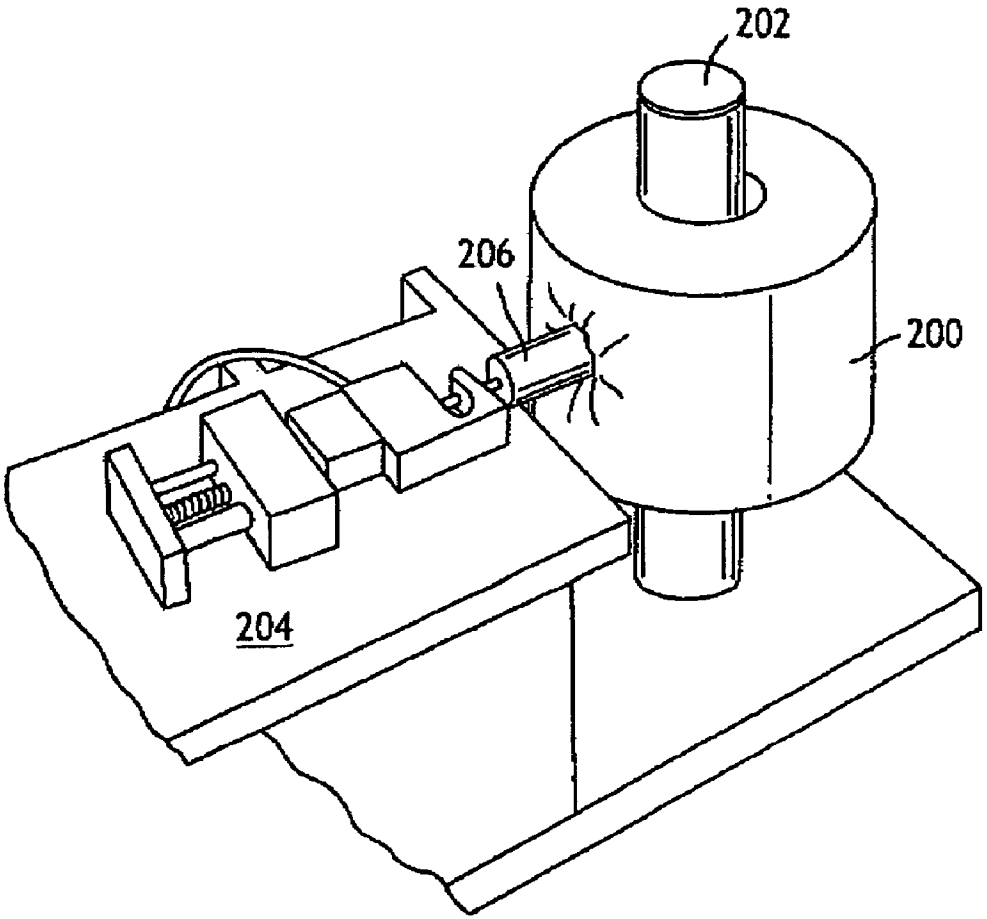
FIG. 7 illustrates a perspective view of an apparatus for determining roll firmness.

The "Kershaw Test" is a test used for determining roll firmness. The Kershaw Test is described in detail in U.S. Pat. No. 6,077,590 to Archer, et al., which is incorporated herein by reference. FIG. 7 illustrates the apparatus used for determining roll firmness. The apparatus is available from Kershaw Instrumentation, Inc., Swedesboro, N.J., and is known as a Model RDT-2002 Roll Density Tester. Shown is a towel or bath tissue roll 200 being measured, which is supported on a spindle 202. When the test begins, a traverse table 204 begins to move toward the roll. Mounted to the traverse table is a sensing probe 206. The motion of the traverse table causes the sensing probe to make contact with the towel or bath tissue roll. The instant the sensing probe contacts the roll, the force exerted on the load cell will exceed the low set point of 6 grams and the displacement display will be zeroed and begins indicating the penetration of the probe. When the force exerted on the sensing probe exceeds the high set point of 687 grams, the value is recorded. After the value is recorded, the traverse table will stop and return to the starting position. The displacement display indicates the displacement/penetration in millimeters. The tester will record this reading. Next, the tester will rotate the tissue or towel roll 90 degrees on the spindle and repeat the test. The roll firmness value is the average of the two readings. The test needs to be performed in a controlled environment of 73.4±1.8 degrees F. and 50±2% relative humidity. The rolls to be tested need to be introduced to this environment at least 4 hours before testing.

The "Fuzz-On-Edge" test is an image analysis test that determines fuzzy softness. A higher number represents greater protruding fiber lengths on the surface of the web, enhancing the fuzzy perception of the surface by the consumer. The image analysis data are taken from two glass plates made into one fixture. Each plate has a sample folded over the edge with the sample folded in the CD direction and placed over the glass plate. The edge is beveled to 1/16" thickness.

Figure 8:
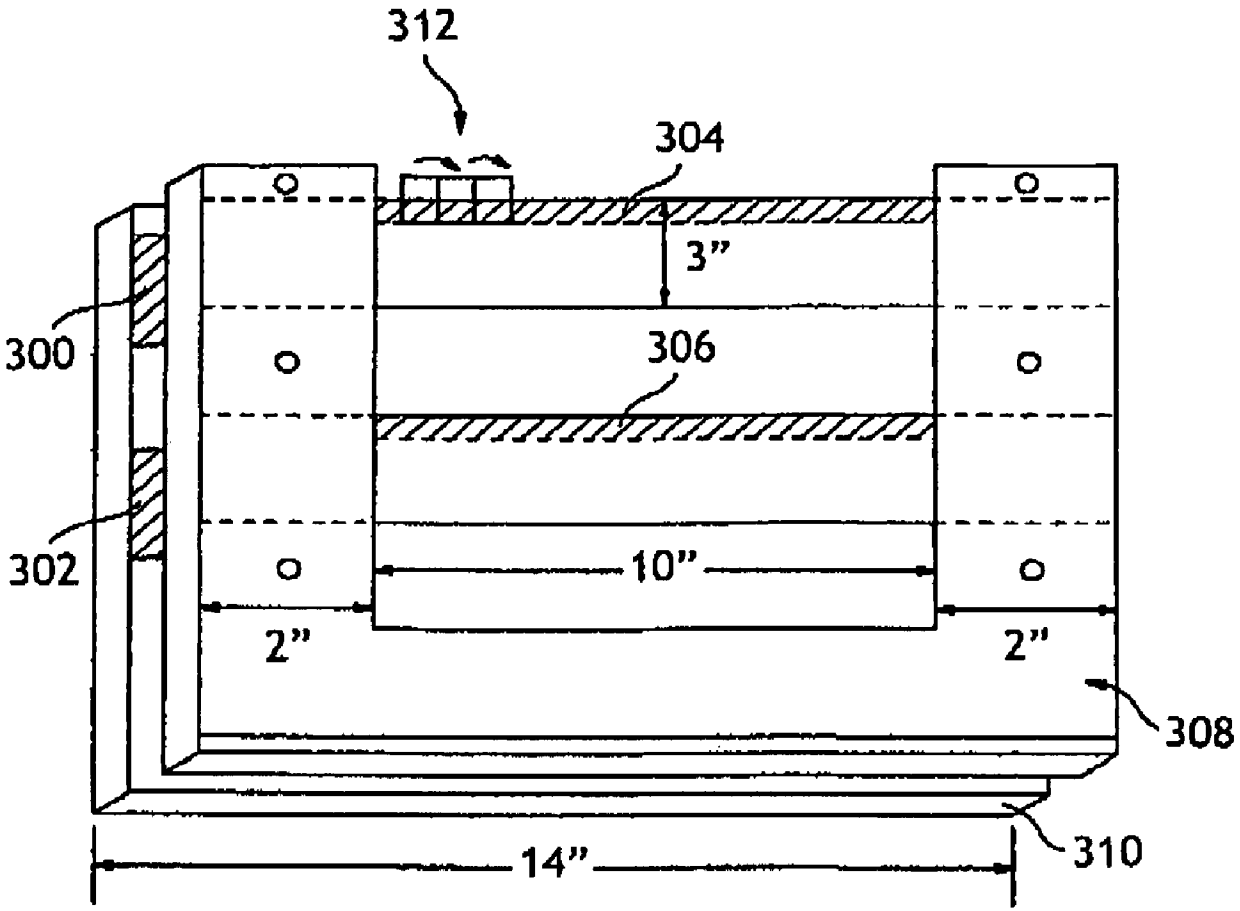
FIG. 8 illustrates a perspective view of a fixture used to conduct a Fuzz-On-Edge test as described herein.

Referring to FIG. 8, one embodiment of a fixture that can be used in conducting the fuzz-on-edge test is shown. As illustrated, the fixture includes a first glass plate 300 and a second glass plate 302. Each of the glass plates has a thickness of ¼ inch. Further, glass plate 300 includes a beveled edge 304, and glass plate 302 includes a beveled edge 306. Each beveled edge has a thickness of 1/16 inch. In this embodiment, the glass plates are maintained in position by a pair of U-shaped brackets 308 and 310. Brackets 308 and 310 can be made from, for instance, ¾ inch finished plywood.

Figure 9:
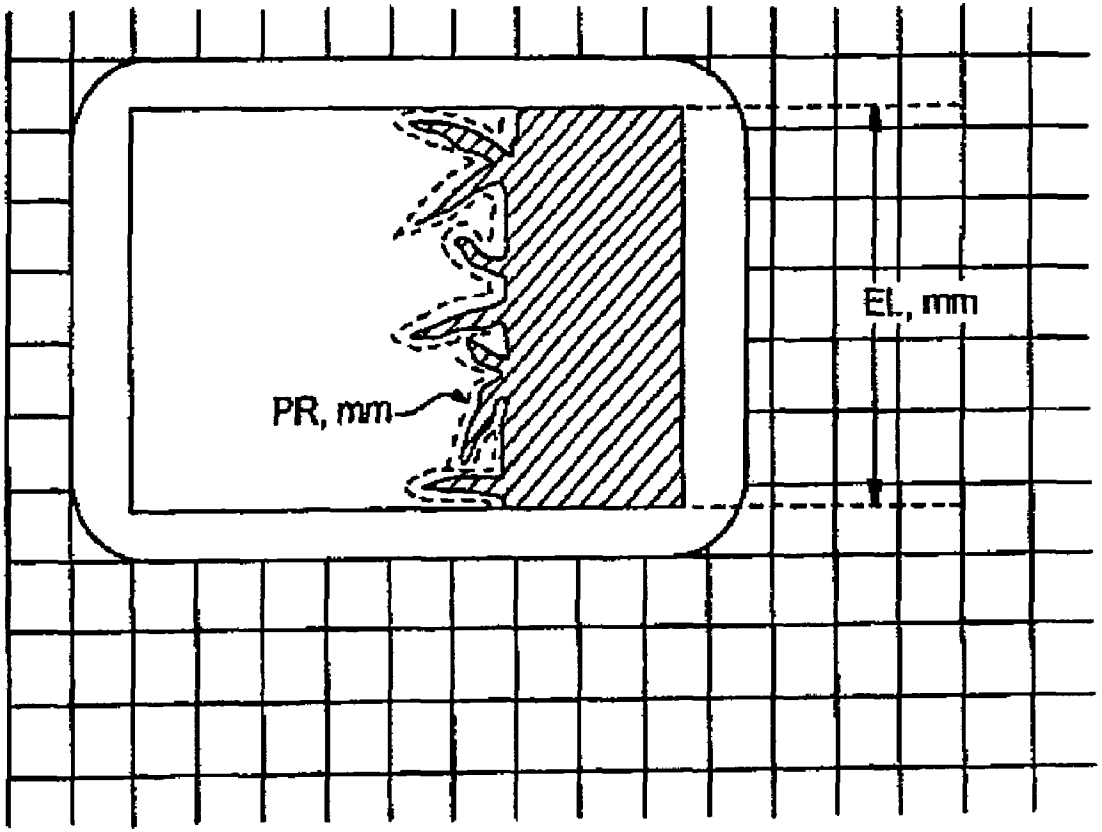
FIG. 9 illustrates a diagrammatical view of the measurements taken during the Fuzz-On-Edge test.

During testing, samples are placed over the beveled edges 304 and 306. Multiple images of the folded edges are then taken along the edge as shown at 312. Thirty (30) fields of view are examined on each folded edge to give a total of sixty (60) fields of view. Each view has "PR/EL" measured before and after removal of protruding fibers. "PR/EL" is perimeter per edge-length examined in each field-of-view. FIG. 9 illustrates the measurement taken. As shown, "PR" is the perimeter around the protruding fibers while "EL" is the length of the measured sample. The PR/EL valves are averaged and assembled into a histogram as an output page. This analysis is completed and the data is obtained using the QUANTIMET 970 Image Analysis System obtained from Leica Corp. of Deerfield, Ill. The QUIPS routine for performing this work, FUZZ10, is as follows:

Cambridge Instruments QUANTIMET 970 QUIPS/MX: VO8.02 USER:

ROUTINE: FUZZIO DATE: 8 May 1981 RUN: 0 SPECIMEN:

```
NAME =   FUZZB
DOES =   PR/EL ON TISSUES; GETS HISTOGRAM
AUTH =   B.E. KRESSNER
DATE =   10 DEC 97
COND =   MACROVIEWER; DCI 12×12; FOLLIES PINK FILTER;
         3×3 MASK 60 MM MICRO-NIKKO, F/4; 20 MM
         EXTENSION TUBES; 2 PLATE (GLASS) FIXTURE
         MICRO-NIKKOR AT FULL EXTENSION FOR
         MAX MAG!
         ROTATE CAM 90 deg SO THAT IMAGE ON RIGHT
         SIDE! ALLOWS TYPICAL PHOTO
Enter specimen identity
Scanner (No. 1 Chalnicon LV= 0.00 SENS= 2.36 PAUSE)
Load Shading Corrector (pattern - FUZZ7)
Calibrate User Specified (Cal Value – 9.709 microns per pixel)
SUBRTN STANDARD
TOTPREL: = 0.
TOTFIELDS: = 0.
PHOTO: = 0.
MEAN: = 0.
If PHOTO = 1, then
Pause Message
```

-continued

```
WANT TYPICAL PHOTO (1 = YES; 0 = NO)?
Input PHOTO
Endif
If PHOTO = 1, then
Pause Message
INPUT MEAN VALUE FOR PR/EL
Input MEAN
Endif
For SAMPLE = 1 to 2
If SAMPLE = 1, then
STAGEX: = 36,000.
STAGEY: = 144,000.
Stage Move (STAGEX, STAGEY)
Pause Message
please position fixture
Pause
STAGEX: = 120,000.
STAGEY: = 144,000.
Stage Move (STAGEX, STAGEY)
Pause Message
please focus
Detect 2D (Darker than 54, Delin PAUSE)
STAGEX: = 36,000.
STAGEY: = 144,000.
Endif
If SAMPLE = 2, then
STAGEX: = 120,000.
STAGEY: = 44,000.
Stage Move (STAGEX, STAGEY)
Pause Message
please focus
Detect 2D (Darker than 54, Delin)
STAGEX: = 36,000.
STAGEY: = 44,000.
Endif
Stage Move (STAGEX, STAGEY)
Stage Scan    (          X       Y
        scan origin   STAGEX   STAGEY
        field size    6,410.0     78,000.0
        no of fields    30          1)
For FIELD
If TOTFIELDS = 30, then
Scanner (No. 1 Chalnicon AUTO-SENSITIVITY LV= 0.01)
Endif
Live Frame is Standard Image Frame
Image Frame is Rectangle (X: 26, Y: 37, W: 823, H: 627)
Scanner (No. 1 Chalnicon AUTO-SENSITIVITY LV= 0.01)
Image Frame is Rectangle (X: 48, Y: 37, W: 803, H: 627)
Detect 2D (Darker than 54, Delin)
Amend (OPEN by 0)
Measure field – Parameters into array FIELD
BEFORPERI: = FIELD PERIMETER
Amend (OPEN by 10)
Measure field – Parameters into array FIELD
AFTPERIM:= FIELD PERIMETER
PROVEREL: =((BEFORPERI – AFTPERIM) / (I.FRAME.H *
CAL.CONST))
TOTPREL: = TOTPREL + PROVEREL
TOTFIELDS: = TOTFIELDS + 1.
If PHOTO = 1, then
If PROVEREL > (0.95000 * MEAN) then
If PROVEREL < (1.0500 * MEAN) then
Scanner (No. 1 Chalnicon AUTO-SENSITIVITY LV= 0.01 PAUSE)
Detect 2D (Darker than 53 and Lighter than 10, Delin PAUSE)
Endif
Endif
Endif
Distribute COUNT vs PROVEREL (Units MM/MM)
    into GRAPH from 0.00 to 5.00 into 20 bins, differential
Stage Step
Next FIELD
Next
Print " "
Print "AVE PR-OVER-EL (UM/UM) =", TOTPREL / TOTFIELDS
Print " "
Print "TOTAL NUMBER OF FIELDS =", TOTFIELDS
Print " "
Print "FIELD HEIGHT (MM) = ", I.FRAME.H * CAL.CONST / 1000
Print " "
```

-continued

```
Print " "
Print Distribution (GRAPH, differential, bar chart, scale = 0.00)
For LOOPCOUNT = 1 to 26
Print " "
Next
END OF PROGRAM
```

After the PR/EL number is established for one sample, as above, four (4) additional test samples from the test material are analyzed. The final Fuzz-On-Edge Test value is the average of the PR/EL number for the five samples.

The MD or CD "Kawabata Bending Stiffness" was measured using the Kawabata Evaluation System (KES) test instrument KES model PB or equivalent. The KES instrument is available from Kato Tech Co., Ltd., 26 Karato-Cho, Nishikugo, Minami-Ku Kyoto 6701-8447 Japan. Turn the power on and allow unit to warm up 15 minutes prior to testing.

All testing is done in a standard laboratory atmosphere of 23+/−2° C. and 50+/−5% relative humidity. All test specimens must be conditioned for at least 4 hours prior to testing. To measure bending, the sample is clamped in an upright position between two chucks and a 0.4 mm center adjustment plate is used for bath tissue. (The size of the adjustment plate is dependent on the sample thickness and should be selected accordingly). One of the chucks is stationary while the other rotates in a curvature between 2.5 $cm^{-1}$ and −2.5 $cm^{-1}$.

The movable chuck moves at a rate of 0.5 $cm^{-1}$/sec. The force (grams force*$cm^2$/cm) taken to bend the material vs. the curvature is plotted. For bath tissue samples, the following instrument settings were used:

Measurement mode=one cycle
Sensitivity=2 and X5
K Span Control=SET
Curvature=+/−2.5 $cm^{-1}$.

For other materials, other settings may be required. Check that the OSC is 10 volts, the BAL is 0 volts, and the MES is 0 volts prior to testing.

Use the KES program and select Tester(S), then FB2-Standard, then Measure(M) and then Optional Condition. Under Sample select Fabrics, Films. Under Meas Mode, select one cycle. Under Sensitivity select the appropriate setting used above (2 and X5). Under Sample Width enter 10 centimeter. Under Curvature enter appropriate setting used above (2.5). Under Repetition enter 1.

For bath tissue, cut the test sample 10 cm by 10 cm, keeping track of the MD and CD orientations of the sample. Other materials may require a different sample size. Insert the sample for either MD or CD bend testing and ensure that the analog meter is 0 volts before and after inserting the sample. Adjust the Zero ADJ dial as needed to zero the analog meter. On the computer, select either WARP for MD testing or WEFT for CD testing. Enter sample information and then select Measure(M) and Auto Start. Ensure the values in the two B gf $cm^2$/cm input boxes display 0.5 and 1.5 for bath tissue. Other specimens may need to be changed to 0.0 and 0.5.

The KES system algorithm computes the following bending characteristic values: B=bending stiffness (grams force× $cm^2$/cm) and 2HB=bending hysteresis (grams force×cm/cm).

Both MD and CD bending stiffness was tested for each sample. Five (5) representative samples are tested for the test material in either direction. The mean bending stiffness (B) is calculated by taking the arithmetic average of the five MD and CD measurements. The mean bending stiffness (B) in either the MD or CD is referred to herein as MD or CD "Kawabata Bending Stiffness".

"Wet Out Time" is a measure of how fast the tissue product absorbs water and reaches its absorbent capacity, expressed in seconds. In particular, the Wet Out Time is determined by selecting and cutting twenty (20) representative product specimen sheets (if a multi-ply product, such as two-ply facial tissue sheets, all plies are tested) into squares measuring 63 millimeters by 63 millimeters (±3 mm.). The resulting twenty sheets are assembled into a pad by stacking the twenty individual sheets one atop another while aligning their edges, forming a specimen pad. The specimen pad is then stapled together across each corner of the specimen pad just far enough from the edges to hold the staples. The staples should be oriented diagonally across each corner and should not wrap around the edges of the test specimen. With the staple points facing down, the specimen pad is held horizontally approximately 25 millimeters from the surface of a pan of distilled or deionized water at a temperature of 23° C.±3° C. The pan should be large enough and filled with water deep enough to initially float the specimen pad without touching the edges or bottom of the pan. The specimen pad is dropped flat onto the surface of the water and the time for the specimen pad to become completely visually saturated with water is recorded. This time, measured to the nearest 0.1 second, is the Wet Out Time for the specimen pad. At least five (5) replicate measurements are made by assembling a new specimen pad from the same test material to yield a reliable average. The reliable average is reported as the Wet Out Time in seconds.

EXAMPLES

The following examples are intended to illustrate particular embodiments without limiting the scope of the appended claims.

Example 1

A single-ply, three-layered uncreped throughdried bath tissue was made using eucalyptus fibers for the outer layers and softwood fibers for the inner layer. Prior to pulping, a quaternary ammonium softening agent (PROSOFT TQ1003 sold by Hercules Incorporated) was added at a dosage of 4.1 kg/Mton of active chemical per metric ton of fiber to the eucalyptus furnish. After allowing 20 minutes of mixing time, the slurry was dewatered using a belt press to approximately 32 percent consistency. The filtrate from the dewatering process was either sewered or used as pulper make-up water for subsequent fiber batches but not sent forward in the stock preparation or tissuemaking process. The thickened pulp containing the debonder was subsequently re-dispersed in water and used as the outer layer furnishes in the tissue-making process.

The softwood fibers were pulped for 30 minutes at 4 percent consistency and diluted to 3.2 percent consistency after pulping, while the debonded eucalyptus fibers were diluted to 2 percent consistency. The overall layered sheet weight was split 30 percent/40 percent/30 percent among the eucalyptus/refined softwood/eucalyptus layers. The center layer was refined to levels required to achieve target strength values, while the outer layers provided the surface softness and bulk. HERCOBOND 1336 available from Hercules Incorporated was added to the center layer at 2-4 kilograms per tonne of pulp based on the center layer.

A three-layer headbox was used to form the web with the refined northern softwood kraft stock in the two center layers of the headbox to produce a single center layer for the three-layered product described. Turbulence-generating inserts recessed about 3 inches (75 millimeters) from the slice and layer dividers extending about 1 inch (25.4 millimeters) beyond the slice were employed. The net slice opening was about 0.9 inch (23 millimeters) and water flows in all four headbox layers were comparable. The consistency of the stock fed to the headbox was about 0.09 weight percent.

The resulting three-layered sheet was formed on a twin-wire, suction form roll, former with forming fabrics being Lindsay 2164 and Asten 867 a fabrics, respectively. The speed of the forming fabrics was 11.9 meters per second. The newly-formed web was then dewatered to a consistency of about 20-27 percent using vacuum suction from below the forming fabric before being transferred to the transfer fabric, which was traveling at 9.1 meters per second (30 percent rush transfer). The transfer fabric was an Appleton Wire T807-1. A vacuum shoe pulling about 6-15 inches (150-380 millimeters) of mercury vacuum was used to transfer the web to the transfer fabric.

The web was then transferred to a throughdrying fabric (Lindsay wire T1205-1). The throughdrying fabric was traveling at a speed of about 9.1 meters per second. The web was carried over a Honeycomb throughdryer operating at a temperature of about 350° F. (175° C.) and dried to final dryness of about 94-98 percent consistency. The resulting uncreped tissue sheet was then wound into several parent rolls of tissue.

A parent roll of tissue, as made above, was then converted using the roll gap shear calendering device of FIG. 2. The shear-calendering device was in a fixed-gap mode and utilized a 40 P&J polyurethane roll in contact with the air side of the sheet and a 40 P&J polyurethane roll in contact with the fabric side. The gap between the rolls was adjusted to 0.003 inches. The lower polyurethane roll was run at a speed 10 percent faster than the upper polyurethane roll, which was running 500 fpm. The web was then run through the UFD process prior to being wound into a tissue roll.

A conventional polysiloxane formulation was applied to the fabric side of the through-dried tissue web using a uniform fiber depositor marketed by ITW Dynatec, Hendersonville, Tenn., and applied in a discontinuous fashion to the tissue web. The uniform fiber depositor had 17 nozzles per inch and operated at an air pressure of 20 psi. The die applied a fiberized neat polysiloxane composition onto the web. The polysiloxane Wetsoft CTW used in this example was obtained from Kelmar Industries located in Duncon, S.C. 29334. The polysiloxane was added to the web to yield an add-on level of 2.0 weight percent total add-on based on the weight of the tissue (1.0 percent each side).

To wind the tissue, the winder was set at 115 mm diameter, 182 sheet count, and 104 mm sheet length. The finished product diameter measured 116 mm. The roll had a roll bulk of 13.9 cc/g and a Fuzz-On-Edge of 2.8 mm/mm for the fabric side of the web having the topically applied polysiloxane formulation. The roll had a Kershaw roll firmness of 9.6 mm. The tissue had a CD Kawabata Bending Stiffness of 0.041 gram-force $cm^2$/cm. The tissue had a Wet Out Time of 5.9 seconds.

Example 2

Example 2 was produced as Example 1, and the shear calender device was operated at a 0.003 inch gap. The lower polyurethane roll was run at a speed 10 percent faster than the upper polyurethane roll, which was running 500 fpm. The web was then run through the UFD process prior to being wound into a tissue roll.

To wind the tissue, the winder was set at 120 mm diameter, 227 sheet count, and 104 mm sheet length. The finished product diameter measured 116 mm. The roll had a roll bulk of 11.7 cc/g and a Fuzz-On-Edge of 2.4 mm/mm for the fabric side of the web having the topically applied polysiloxane formulation. The roll had a Kershaw roll firmness of 10.6 mm. The tissue had a CD Kawabata Bending Stiffness of 0.030 gram-force $cm^2$/cm. The tissue had a Wet Out Time of 5.8 seconds.

Example 3

Example 3 was produced as Example 1, except that the shear calender device was operated at a 0.004 inch gap. The lower polyurethane roll was run at a speed 10 percent faster than the upper polyurethane roll, which was running 500 fpm. The web was then run through the UFD process prior to being wound into a tissue roll.

To wind the tissue, the winder was set at 123 mm diameter, 190 sheet count, and 104 mm sheet length. The finished product diameter measured 121 mm. The roll had a roll bulk of 15.5 cc/g and a Fuzz-On-Edge of 1.8 mm/mm for the fabric side of the web having the topically applied polysiloxane formulation. The roll had a Kershaw roll firmness of 11.5 mm. The tissue had a CD Kawabata Bending Stiffness of 0.045 gram-force cm 2/cm. The tissue had a Wet Out Time of 4.0 seconds.

Control 1

A parent roll of tissue as made above was then converted using standard techniques, specifically, a single conventional polyurethane/steel calender instead of the shear calendering device. The calender contained a 40 P&J polyurethane roll on the air side of the sheet and a standard steel roll on the fabric side. The calender was operated in a standard fixed-load mode at 50 pli and at 500 fpm to produce control tissue.

29334. The polysiloxane was added to the web to yield an add-on level of 2.0 weight percent total add-on based on the weight of the tissue (1.0 percent each side).

To wind the tissue, the winder was set at 115 mm diameter, 182 sheet count, and 104 mm sheet length. The finished product diameter measured 116 mm. The roll had a roll bulk of 13.4 cc/g and a Fuzz-On-Edge of 1.5 mm/mm for the fabric side of the web having the topically applied polysiloxane formulation. The roll had a Kershaw roll firmness of 9.0 mm. The tissue had a CD Kawabata Bending Stiffness of 0.062 gram-force $cm^2$/cm. The tissue had a Wet Out Time of 4.5 seconds.

Control 2

A parent roll of tissue as made above was then converted using the roll gap apparatus of FIG. 2. However, for control purposes the polysiloxane formulation was not applied to the tissue representing the maximum generated fuzzy softness prior to applying the topical chemistry. The shear-calendering device was in a fixed-gap mode and utilized a 40 P&J polyurethane roll in contact with the air side of the sheet and a 40 P&J polyurethane roll in contact with the fabric side. The gap between the rolls was adjusted to 0.003 inches. The lower polyurethane roll was run at a speed 10 percent faster than the upper polyurethane roll, which was running 500 fpm. The web was then wound into a tissue roll.

To wind the tissue, the winder was set at 115 mm diameter, 182 sheet count, and 104 mm sheet length. The finished product diameter measured 116 mm. The roll had a roll bulk of 14.0 cc/g and a Fuzz-On-Edge of 3.1 mm/mm for the fabric side of the web without the topically applied polysiloxane formulation. The roll had a Kershaw roll firmness of 8.8 mm. The tissue had a CD Kawabata Bending Stiffness of 0.037 gram-force $cm^2$/cm. The tissue had a Wet Out Time of 4.9 seconds.

TABLE 1

| Sample | Control 1 | Control 2 | Example 1 | Example 2 | Example 3 | KLEENEX ALOE and E | CHARMIN PLUS |
|---|---|---|---|---|---|---|---|
| Roll Bulk (cc/g) | 13.4 | 14.0 | 13.9 | 11.7 | 15.5 | 9.2 | 8.8 |
| Fuzz-on-Edge Fabric Side (mm/mm) | 1.5 | 3.1 | 2.8 | 2.4 | 1.8 | 1.6 | 1.8 |
| Kershaw Roll Firmness (mm) | 9.0 | 8.8 | 9.6 | 10.6 | 11.5 | 8.6 | 4.7 |
| CD Kawabata Bending Stiffness (gram-force $cm^2$/cm) | 0.062 | 0.037 | 0.041 | 0.030 | 0.045 | 0.037 | 0.037 |
| Wet Out Time (sec) | 4.5 | 4.9 | 5.9 | 5.8 | 4.0 | 4.2 | 6.9 |

After calendering, a conventional polysiloxane formulation was applied to the fabric side of the through-dried tissue web using a uniform fiber depositor marketed by ITW Dynatec, Henderson, Tenn., and applied in a discontinuous fashion to the tissue web. The uniform fiber depositor had 17 nozzles per inch and operated at an air pressure of 20 psi. The die applied a fiberized neat polysiloxane composition onto the web. The polysiloxane Wetsoft CTW used in this example was obtained from Kelmar Industries located in Duncon, S.C.

The properties of the invention, control samples, and commercially available bath tissue products are shown in Table 1 above. As seen, Example 1 of the invention has nearly the same Fuzz-On-Edge value for the fabric side as Control 2, produced without any applied chemistry, and the same roll bulk. Thus, the fuzzy softness of the tissue is preserved by the invention. Furthermore, Examples 1 and 2 of the invention have significantly higher Fuzz-On-Edge values for the fabric side than Control 1, KLEENEX ALOE and E, or CHARMIN PLUS indicating a higher level of fuzzy softness for a tissue sheet having a topically applied chemistry than previously possible.

Additionally, the CD Kawabata Bending Stiffness value for Examples 1 and 2 are low when one considers the high Roll Bulk values of these examples. Without wishing to be bound by theory, it is believed that CD Kawabata Bending Stiffness is a function of thickness and weight of the tissue. Examples 1 and 2 have CD Kawabata Bending Stiffness values close in value to KLEENEX ALOE and E or CHARMIN PLUS. However, the Roll Bulk of Examples 1 and 2 are much higher at 13.9 cc/g and 11.7 cc/g compared to 9.2 cc/g and 8.8 cc/g for the commercially available tissue. Previously, it was not thought possible to achieve roll bulks exceeding 10 cc/g without significantly increasing the tissue's bending stiffness from the increased thickness of the higher bulk tissue. It is believed that the gap shear calendering process significantly lowers the CD Kawabata Bending Stiffness for the tissue as compared to conventional calendering, which was used to produce Control 1.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

We claim:

1. A product comprising:

a single ply web comprising cellulosic fibers having a first and a second opposing sides;

a plurality of extruded filaments of a chemical additive extruded onto the first and/or second opposing side of the web;

the single ply web wound into a roll;

the roll having a roll bulk about 10 cc/g or greater; and the first and/or second opposing side with the chemical additive filaments having a Fuzz-On-Edge about 1.8 mm/mm or greater.

2. A product comprising:

an uncreped throughdried single ply tissue web comprising cellulosic fibers having a first and a second opposing sides;

a plurality of extruded filaments of a chemical additive extruded onto the first and/or second opposing side of the web;

the tissue web wound into a roll;

the roll having a roll bulk about 10 cc/g or greater; and the first and/or second opposing side with the chemical additive filaments having a Fuzz-On-Edge about 20 mm/mm or greater.

3. The product of claim 1 or 2 wherein the roll bulk is about 11 cc/g or greater.

4. The product of claim 1 or 2 wherein the roll bulk is between about 10 cc/g to about 16 cc/g.

5. The product of claim 1 or 2 wherein the roll bulk is between about 11 cc/g to about 16 cc/g.

6. The product of claim 5 wherein the Fuzz-On Edge is between about 2.0 mm/mm to about 3.0 mm/mm.

7. The product of claim 6 wherein the CD Kawabata Bending Stiffness is about 0.04 or less.

8. The product of claim 5 wherein the Fuzz-On Edge is between about 2.2 mm/mm to about 2.9 mm/mm.

9. The product of claim 1 or 2 wherein the Fuzz-On Edge is about 2.4 mm/mm or greater.

10. The product of claim 1 or 2 wherein the Fuzz-On Edge is about 2.8 mm/mm or greater.

11. The product of claim 1 or 2 wherein the Fuzz-On Edge is between about 2.0 mm/mm to about 3.0 mm/mm.

12. The product of claim 1 or 2 wherein the web comprises a bath tissue web.

13. The product of claim 1 or 2 wherein the extruded filaments of the chemical additive are extruded onto both the first and the second opposing sides.

14. The product of claim 1 or 2 wherein the chemical additive comprises polysiloxane.

15. The product of claim 1 or 2 wherein the Kershaw firmness is between about 12 mm to about 0 mm.

16. The product of claim 1 or 2 wherein the CD Kawabata Bending Stiffness is about 0.06 or less.

17. The product of claim 1, 2, 5, 13, 6, 14, 15, 16, or 7 wherein the first or second opposing side with the applied chemical contains a plurality of fuzzy fibers generated by a shear calendering device.

18. The product of claim 1 or 2 wherein the chemical additive has a viscosity of between about 1,500 cps to about 10,000 cps.

19. The product of claim 1 or 2 wherein the extruded filaments form a network.

20. The product of claim 1 or 2 wherein the chemical additive has a viscosity of between about 1,000 cps to about 50,000 cps.

21. The product of claim 1 or 2 wherein the extruded filaments of the chemical additive are extruded onto only one opposing side of the web.

22. The product of claim 1 or 2 wherein extruded filaments are continuous.

23. The product of claim 1 or 2 wherein the extruded filaments are discontinuous.

24. The product of claim 1 or 2 wherein the extruded filaments are melt blown.

* * * * *